United States Patent [19]

Hammond

[11] Patent Number: 4,575,783

[45] Date of Patent: Mar. 11, 1986

[54] REFLECTOR FOR ILLUMINATING SIGNS

[75] Inventor: Douglas S. Hammond, Newark, Ohio

[73] Assignee: Manville Service Corporation, Denver, Colo.

[21] Appl. No.: 533,320

[22] Filed: Sep. 16, 1983

[51] Int. Cl.[4] ..... F21S 1/14

[52] U.S. Cl. ..... 362/145; 362/253; 362/346; 362/350; 362/431; 362/812; 40/560; 40/582; 40/624

[58] Field of Search ..... 362/296, 310, 346, 347, 362/350, 812, 145, 253, 297, 431; 40/560, 582, 624

[56] References Cited

U.S. PATENT DOCUMENTS

| | | | |
|---|---|---|---|
| 2,447,923 | 8/1948 | Tuck | 362/347 X |
| 4,451,875 | 5/1984 | Odle et al. | 362/812 X |

*Primary Examiner*—Peter A. Nelson

*Attorney, Agent, or Firm*—John D. Lister; Cornelius P. Quinn

[57] ABSTRACT

In a luminaire for illuminating signs, a reflector having segments for redirecting light to various areas of the sign so as to create a uniformly illuminated sign.

5 Claims, 10 Drawing Figures

Fig. 7.
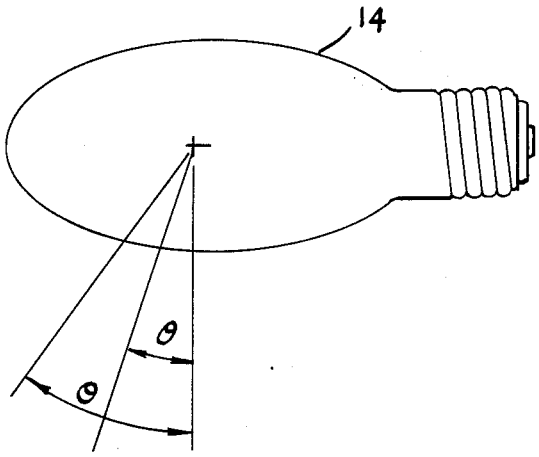
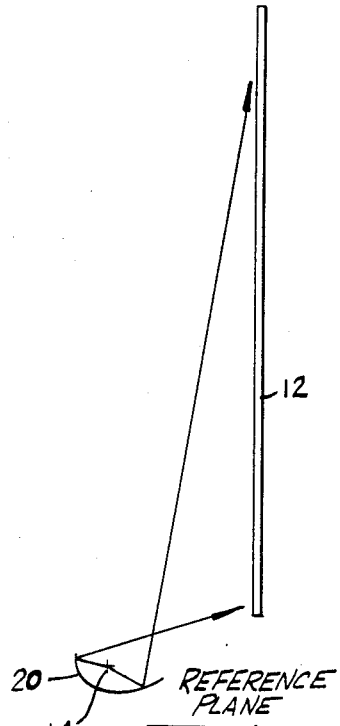
Fig. 6.
Fig. 9.
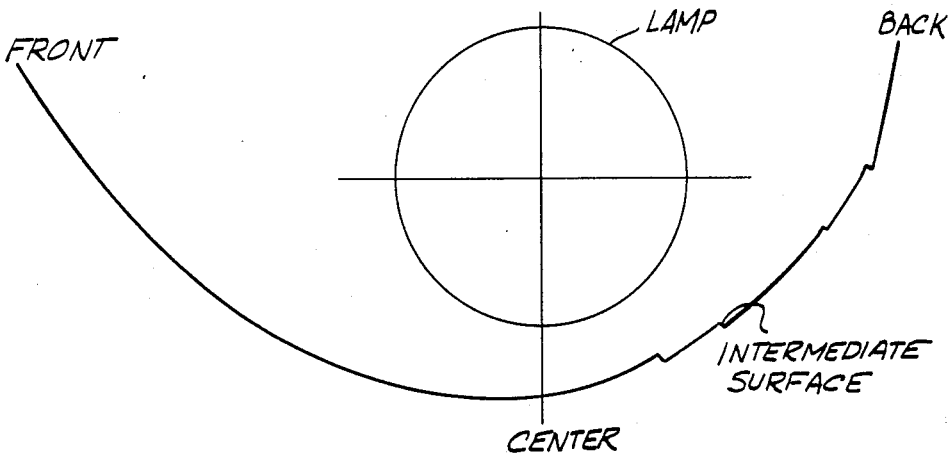

REFLECTOR FOR ILLUMINATING SIGNS

This invention relates to a reflector and more particularly to a new and improved reflector which re-directs light emitted from a lamp to all areas of a sign thus creating a uniform distribution of light on the sign.

In optical systems for illuminating signs prior to the present invention, the lamp was positioned to disperse light to the center of the sign and a reflector behind the lamp was positioned to redirect light to the center of the sign also. Various finishes to the reflector or a lens enclosing luminaire were applied to the optical system to spread or smooth the pool of light. These systems resulted in poor light uniformity on the sign and consequently, a less legible sign.

It is an object of the present invention to provide an optical component which redirects the light emitted from the lamp to all areas of the sign creating a uniform distribution of light.

SUMMARY OF THE INVENTION

Accordingly, the present invention provides a reflector for controlling light that does not directly illuminate a sign. The reflector redirects light to illuminate the sign in areas where desired foot candles are lacking.

BRIEF DESCRIPTION OF THE DRAWINGS

FIG. 6 illustrates that to generate uniform illumination along the vertical centerline of the sign, the front area of the reflector is to redirect the flux to the top of the sign while the back area of the reflector is to redirect flux to the bottom of the sign, the areas of the reflector between these areas redirecting the flux between the top and bottom of the sign.

FIG. 7 illustrates that the angle $\theta$ created by a ray of light emitted from the lamp in reference to the reference plane, increases to correspond with the distribution of flux from the lamp. As angle $\theta$ increases the intensity of the flux decreases.

FIG. 9 is a cutaway view of the reflector illustrating the various segments of the reflector.

Detailed Description of the Invention

Figure 1:
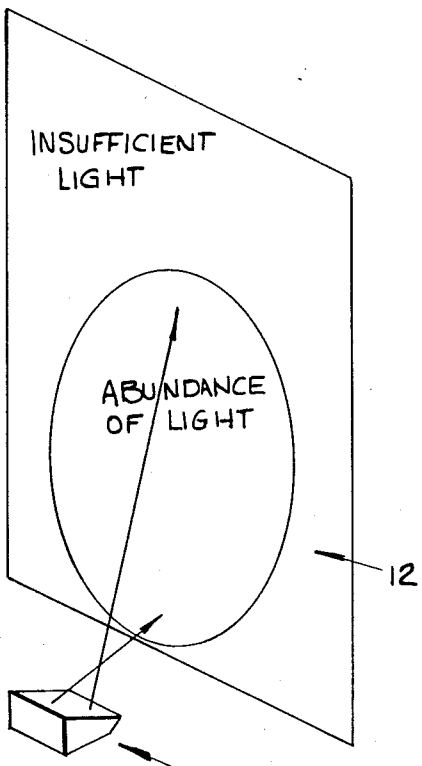
FIG. 1 illustrates a sign illuminated by an optical system of the prior art having poor light uniformity.

Referring now the drawings, there is shown in FIG. 1 a luminaire generally identified by the reference numeral 10 for illuminating a highway sign generally identified by the reference numeral 12. As illustrated in the drawing, both the luminaire's lamp and reflector were positioned to disperse light to the center of the sign, thus providing poor light uniformity and consequently less than desirable legibility to the sign.

Figure 2:
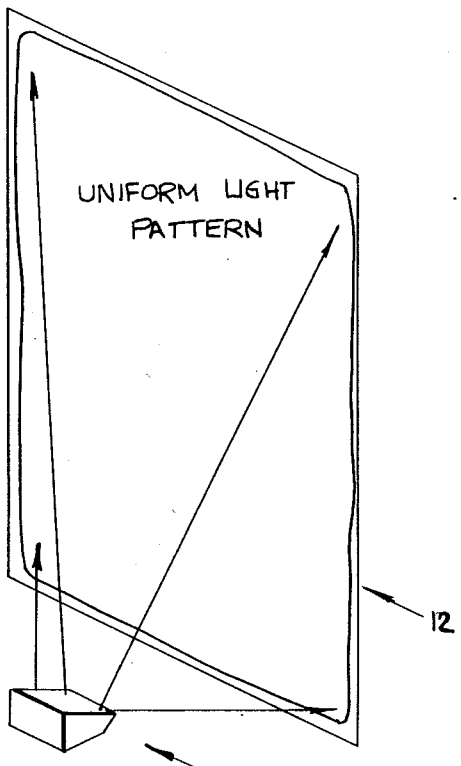
FIG. 2 is a sign illuminated by the optical system of the present invention in which there is a uniform distribution of light.

As illustrated in FIG. 2, the optical design of the present invention is such that light from the luminaire 10 is provided to all the areas of the sign 12 creating a uniform distribution of light.

Figure 3:
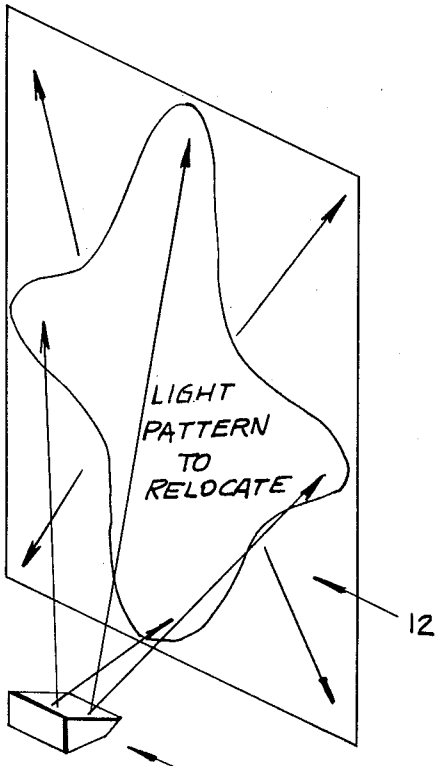
FIG. 3 is an illustration of a sign which, while light has been redirected to the edges of the sign, light still must be redirected to the corners.

As illustrated in FIG. 3, light has to be redirected from the center of the sign to the edges of the sign. Once this has been accomplished, light must still be redirected to the corners.

Figure 4:
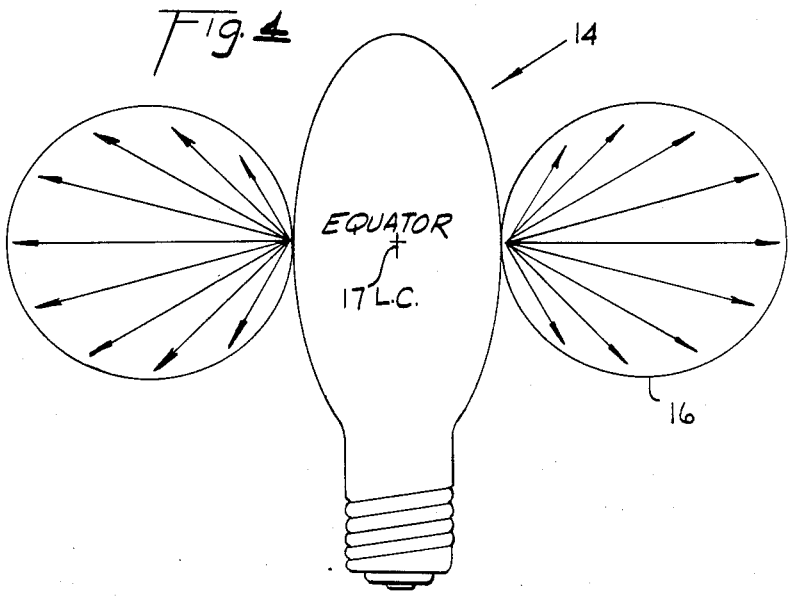
FIG. 4 illustrates how the distribution of luminous flux (light) from a source creates a "doughnut" of light with the center of the "doughnut" being the light center of the lamp, and the most intense flux being emitted about the equator of the lamp.

As illustrated in FIG. 4, distribution of luminance flux (light) from a lamp generally identified by the reference numeral 14, creats a "doughnut" of light 16 with it's center being the light center 17 of the lamp 14 with the most intense flux being emitted about the equator of the lamp.

Since the normal highway sign is approximately 12' wide and 14' in height, it is preferable to position a lamp parallel to the sign to obtain a maximum amount of direct luminance flux on the sign.

Figure 5A:
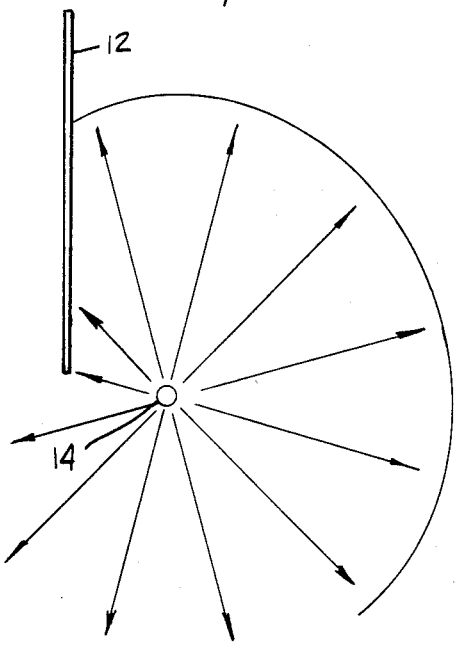
FIG. 5A illustrates a side view of the sign shown in FIG. 5B.
Figure 5B:
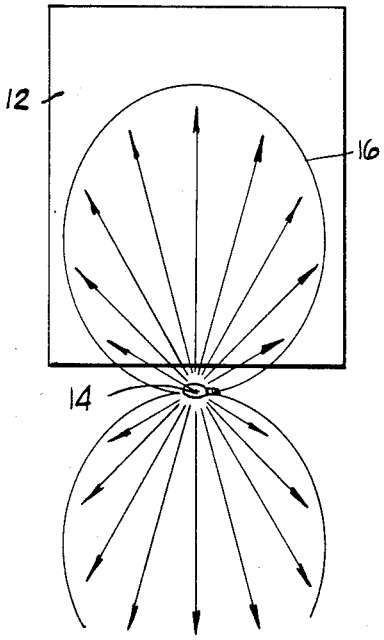
FIG. 5B illustrates a pattern of direct flux being dispersed on a sign from a luminaire positioned one foot below and four foot away from the sign.

With the luminaire 10 positioned 1' below and 4' away from the sign, the lamp 14 will disperse the doughnut of light 16 along the vertical centerline of the sign 12. As illustrated in **5*a* and 5*b* FIG. 5, the bottom edge of the sign 12 is closer to the lamp 14 than the top of the sign 12**, resulting in the flux intensity being greater and more intense at the bottom of the sign.

Figure 10:
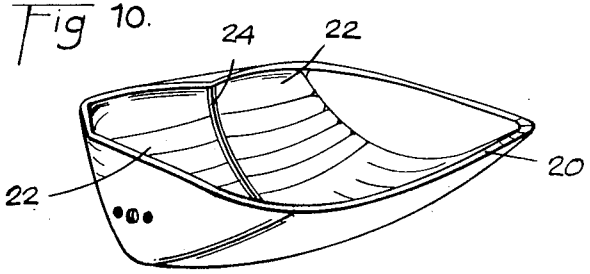
FIG. 10 is a perspective view of the reflector in accordance with the present invention.

Since the direct flux being dispersed on the sign cannot be redirected to provide uniform light distribution, it is the purpose of the present invention to provide a reflector to control the flux that does not directly illuminate the sign, and to redirect it to areas where desired footcandles are lacking. The reflector generally identified by the reference numeral 20 shown in FIG. 10 has a specular aluminum finish with it's contour designed to generate both vertical and lateral illumination on a sign having nominal physical dimensions of about 12' in width and 14' in height.

As discussed previously and illustrated in FIGS. 4 and 5, the intensity of the luminance flux emitted from the equator of the lamp 14 is equal in all directions. Accordingly, to achieve the maximum efficiency from the luminiare, the reflector 20 must engulf as much of the lamp 14 as possible without creating strains on manufacturing the reflector 20 or having a reflector 20 too large so as to make the size of the luminaire undesirable.

As illustrated in FIG. 6, a reference plane 24 was designed creating the contour of the reflector 20 required to provide uniform illumination along the vertical centerline of the sign 12. As illustrated for an optimum physical size of reflector 20, the front area of the reflector 20 (that is, the portion of the reflector closest to the sign) is to redirect flux to the top of the sign while the back area of the reflector 20 (that is, the portion of the reflector furthest from the sign) is to redirect flux to the bottom of the sign with the areas of the reflector 20 between these areas redirecting flux between the top and bottom of the sign.

As described earlier, placing the lamp 14 parallel to the sign 12 and positioning the light center 17 of the lamp 14 located on the reference plane provides the more intense flux to be emitted from the lamp along the reference plane.

The reflector 20 is divided into segments 22 (each segment extending perpendicular to the reference plane). Each segment redirects flux laterally across the sign. As illustrated in FIG. 7 the angle $\theta$ created by a ray of light emitted from the lamp in reference to the reference plane, increases to correspond with the distribution of flux from the lamp. Accordingly, as angle $\theta$ increases, the intensity of the flux decreases. Therefore, as illustrated in FIG. 8, in view of the greater distance to the corners and edges of the sign, in order to achieve maximum uniformity of illumination on the sign 12, the more intense flux must be redirected to these areas.

Figure 8C:
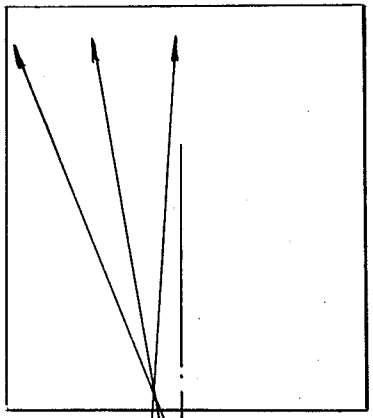
FIGS. 8A, 8B and 8C illustrate that in view of the greater distance to the corners and edges of the sign, a more intense flux must be redirected to those areas to achieve maximum uniformity.
Figure 8B:
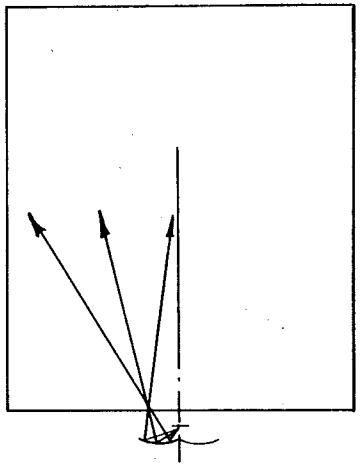
Figure 8A:
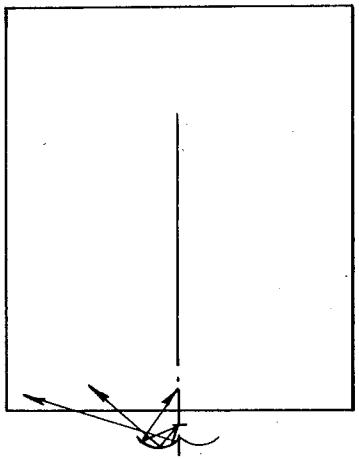

FIG. 8A shows a segment that is located at the back of the reflector (behind the lamp 14) in respect to the sign 12. This segment of the reflector redirects flux uniformly along the bottom of the sign since the center of the sign 12 is illuminated by direct flux emitted from the lamp 14, the more intense flux striking the reflector is redirected or reflected to the edge of the sign as the angle increases as described earlier, while the less intense flux is gradually redirected to the center of the sign.

FIG. 8B illustrates a segment in the center area of the reflector 20. This area of the reflector redirects the flux in the same manner as the back area of the reflector illustrated in FIG. 8A except that it redirects the flux at a higher vertical angle (halfway up the sign).

FIG. 8C illustrates a segment at the front of the reflector 20 which again redirects the flux as described for the previous reflector areas except at a larger vertical angle (to the top of the sign). Intermediate segments are provided to provide uniformity of illumination from the top to the bottom of the sign. While views 8*a*, 8*b* and 8*c* illustrate the redirection of the illumination to the left side of the sign, obviously segment to the right side of the reference plane lluminates the right sie of the sing in the same manner.

The reference plane 22 and each segment 24 of the reflector 20 is precisely calculated to perform its specific function and in combination provide uniform illumination on the sign 12. Since the reference plane is the base of the design, each of the segments must interact in harmony with the reference plane. The front and center areas of the reflector 20 intersect at common points which provide a smooth contour. However, because of the severity of the angular change in the back area of the reflector 20 in respect to the reference plane and the segments 22 in this area, interaction of the segments and the reference plane does not provide a smooth contour. In order to provide a smooth contour sacrifices would have to be made in terms of uniform illumination at the bottom of the sign. However, in the present invention in order to provide uniform illumination, each segment 22 of the back area of the reflector 20 is joined by an intermediate surface 27 as illustrated in FIG. 9. This interaction of the segments in the back area of the reflector 20 allows the creation of a luminaire providing optimum utilization and efficiency for sign lumination.

While the invention is particularly shown and described in reference to a preferred embodiment thereof, it will be understood by those skilled in the art that various changes in form and details may be made therein without departing from the spirit and scope of the invention.

What is claimed is:

1. A luminaire in combination with a sign, the sign being of the type having its vertical length longer than its horizontal comprising, a lamp providing luminance flux positioned below and away from, yet parallel to the sign and parallel to the horizontal center of the area to be illuminated so as to provide a maximum amount of luminance directly to the vertical sign and reflector means for redirecting luminance flux which does not directly illuminate the sign to areas where desired luminance is lacking said reflector means including a reference plane along the centerline with left and right segments intersecting thereat, said segments redirecting more intense flux to the corners and edges of the sign.

2. A luminaire as defined in claim 1 wherein a front area of said reflector redirects flux to the top of the sign while a back area of the reflector redirects flux to the bottom of the sign with the areas of the reflector between these front and back areas redirecting flux between the top and bottom of the sign.

3. A luminaire as defined in claim 2 wherein said reflector is divided into lateral segments with each segment redirecting flux laterally across the sign, the more intense flux being redirected to corners and edges of the sign and less intensive flux being redirected to the center of the sign.

4. A luminaire as defined in claim 3 wherein the front and center segments of the reflector intersect at common points providing a smooth contour while the segments in the back area of the reflector due to the severity of the angular changes between segments in the back area of the reflector are joined by intermediate surfaces.

5. A luminaire as defined in claim 1 wherein said reflector means comprises a specular aluminum reflector.

* * * * *